US005377586A

United States Patent [19]

Matsuno

[11] Patent Number: 5,377,586

[45] Date of Patent: Jan. 3, 1995

[54] PAPER ROLL SUPPORT APPARATUS

[75] Inventor: Ryuji Matsuno, Shimosuwa, Japan

[73] Assignees: Kabushiki Kaisha Sankyo Seiki Seisakusho, Nagano; Kabushiki Kaisha Toshiba, Kawasaki, both of Japan

[21] Appl. No.: 30,087

[22] PCT Filed: Jul. 29, 1992

[86] PCT No.: PCT/JP92/00957

§ 371 Date: Mar. 26, 1993

§ 102(e) Date: Mar. 26, 1993

[87] PCT Pub. No.: WO93/02954

PCT Pub. Date: Feb. 18, 1993

[30] Foreign Application Priority Data

Jul. 29, 1991 [JP] Japan ..... 3-059399
Aug. 2, 1991 [JP] Japan ..... 3-061186

[51] Int. Cl.[6] ..... B41F 13/54

[52] U.S. Cl. ..... 101/228; 242/551

[58] Field of Search ..... 400/611, 612, 613, 613.1; 101/138, 219, 228; 242/55.3, 68.7, 58.1, 58.2, 58.3, 58.4, 58.5

[56] References Cited

U.S. PATENT DOCUMENTS

| | | | |
|---|---|---|---|
| 3,194,508 | 7/1965 | Netze | 242/58.2 |
| 3,861,612 | 1/1975 | Kubo | 242/58.3 |
| 4,389,026 | 6/1983 | Willa et al. | 242/55.3 |
| 4,757,951 | 7/1988 | Ludszeweit | 242/58.1 |
| 4,856,724 | 8/1989 | Jespersen | 242/55.3 |

FOREIGN PATENT DOCUMENTS

| | | |
|---|---|---|
| 63-61079 | 4/1988 | Japan . |
| 3-279146 | 12/1991 | Japan . |

*Primary Examiner*—Ren Yan
*Attorney, Agent, or Firm*—Oblon, Spivak, McClelland, Maier & Neustadt

[57] ABSTRACT

A paper roll support apparatus comprises a main paper roll support (12, 13), a paper roll feed element (22) for unrolling a main paper roll (10), a spare paper roll support (42, 43, 47, 48) for supporting a spare paper roll (11) and located behind the main paper roll support (12, 13), a residual sensor (39, 41) for detecting a residual of the paper roll, and a spare paper roll setter (43, 47, 48, 52) controlled by the residual sensor (39, 41).

3 Claims, 8 Drawing Sheets

PAPER ROLL SUPPORT APPARATUS

FIELD OF THE INVENTION

This invention relates to a printer for printing a balance or remittance report on a paper roll in an automatic teller machine or the like, and more particularly is directed to a paper roll support apparatus for such a printer which includes mechanisms for resupplying and guiding paper rolls and releasing used empty rolls.

DESCRIPTION OF THE RELATED ART

An automatic banking machine such as an automatic teller machine (ATM) or a cash dispenser is used to deposit or draw money or to make remittance by using a magnetic card like a credit card or a cash card. The automatic teller machine includes a printer for printing a balance or remittance report (called "balance report" hereinafter). The printer usually operates on the thermal transfer recording or thermal recording system, unrolls the paper roll and prints each balance report on the unrolled paper, cuts the paper to a prederemined length, and supplies the balance report to the customer. The paper roll is rotatably seated on a support without a support shaft. Since the paper on the roll is consumed each time the balance report is issued, a new paper roll is set on the support by detecting the residual of the paper roll according to the number of issued balance reports or the reduced diameter of the paper roll, or visually detecting the residual of the paper.

The automatic teller machine including the printer is generally installed in a relatively narrow space, and is required to be compact as a whole. Therefore, the paper roll is usually dropped into the support from above or is rolled into the support from behind.

The paper roll is unwound on the support in the predetermined direction. When it is placed in a wrong direction, the paper roll should be correctly reloaded.

The more frequently the automatic teller machine is operated, the faster the paper roll is consumed and a new paper roll has to be resupplied more frequently. For this purpose, a spare paper roll is also placed beside the main paper roll in use so that the automatic banking service can be offered without interruption.

The automatic teller machine should be not only compact as described above but also be simply designed to facilitate work such as replenishment of a new paper roll or release of a used paper roll.

With the foregoing problems in mind, it is therefore an object of this invention to provide a paper roll support apparatus for a printer which is compact in size, is easy to resupply a new paper roll and release a consumed paper roll, and can issue the balance reports on the new paper roll without interrupting the automatic banking service.

A further object of the invention is to provide a paper roll support apparatus which can easily release a consumed paper roll in a narrow limited space.

A still further object of the invention is to provide a paper roll support apparatus which can reliably support paper rolls and can assure easy resupply of new paper rolls.

SUMMARY OF THE INVENTION

According to a first aspect of the invention, there is provided a paper roll support apparatus comprising: a main paper roll support for rotatably supporting a main paper roll; paper feed unit for unrolling the main paper roll and feeding the paper; a spare paper roll support for supporting a spare paper roll and located behind the main paper roll support; a residual sensor for detecting a residual of the main paper roll supported by the main paper roll support; and a setting unit for setting the spare paper roll according to the residual of the main paper roll detected by the residual sensor.

In a second aspect of the invention, there is provided a paper roll support apparatus for a printer, comprising: a main paper roll support for rotatably supporting a main paper roll; a paper feed unit for unrolling the main paper roll and feeding the paper; a printing unit for printing a balance report on the paper unrolled and fed by the paper feed unit; a spare paper roll support for supporting a spare paper roll and located behind the main paper roll support; a spare paper roll stop for preventing the spare paper roll from advancing toward the main paper roll support; a residual sensor for detecting a residual of the main paper roll supported by the main paper roll support; and a setting unit for setting the spare paper roll according to the residual of the main paper roll detected by the residual sensor. The spare paper roll stop is positioned so as to be reciprocative in a paper roll path between the spare roll support and the main paper roll support.

According to a third aspect of the invention, there is provided a paper roll support apparatus comprising a paper roll guiding means and a paper roll releasing mechanism. The paper roll guiding means includes: a stationary guide member for rotatably holding at a predetermined position the main paper roll supported by the main paper roll support; and at least one movable guide member which is a counterpart of the stationary guide member and is movable between a main position for holding the main paper roll and a side position for releasing the main paper roll. The paper roll releasing mechanism includes: a paper roll release lever for pushing and releasing the main paper roll, being movable between an inoperative position away from the main paper roll and an operative position for striking the main paper roll and being located opposite to the movable member with the main paper roll sandwiched therebetween; an operating member for selectively moving the paper roll release lever to either the inoperative or operative position; and a moving means for moving the movable guide member to the side position in response to the operation of the operating member.

In a fourth apsect of the invention, there is provided a paper roll support apparatus further comprising a guide mechanism which includes: a stationary guide member for surrounding a part of the peripheral surface of the main paper roll supported by the main paper roll support; at least one movable guide member which is a counterpart of the stationary guide member and is movable between a main position for holding the main paper roll and a side position for moving the main paper roll; guide pieces which rock freely on a part of the movable guide member, has an engaging member for keeping the movable guide member located at the holding with a predetermined angle to the movable guide member, and covers the other part of the peripheral surface of the main paper roll; a stop member which engages with the guide piece when the movable guide member is placed on the holding position, thereby preventing movement of the movable guide member; a spring for urging the movable guide member toward the holding position;

and a driving unit for moving the movable guide member from the holding position to the side position.

A record of transactions in a bank account is printed on the paper unrolled from the paper roll, and is issued as a balance report to the customer. When the residual sensor detects that the main paper roll is used out, the spare paper roll stop retracts itself from the paper roll path between the main paper roll support and the spare paper roll support. Thereafter, the spare paper roll is advanced to the main paper roll support from the spare paper roll support located behind the main paper roll support. To replace the main paper roll which becomes small with a new paper roll, the paper roll stop is retracted from the paper roll path, and the main paper roll is moved to the spare paper roll support.

A wrongly set paper roll can be corrected by activating the operating member to release the paper roll. In cooperation with the operating member, the movable guide member of the paper roll guide unit is moved to the side position to release the paper roll. Then, the paper roll release levers are displaced to the operative position to strike the moving paper roll, and release the paper roll from its regular position.

When the movable guide member is at the holding position, the guide piece supported by the movable guide member activates the driving unit for guiding the paper roll. The driving unit displaces the movable guide member to the side position, so that the guide piece retracts from the paper roll path and allow the movement of the paper roll.

DESCRIPTION OF THE PREFERRED EMBODIMENT

Figure 1:
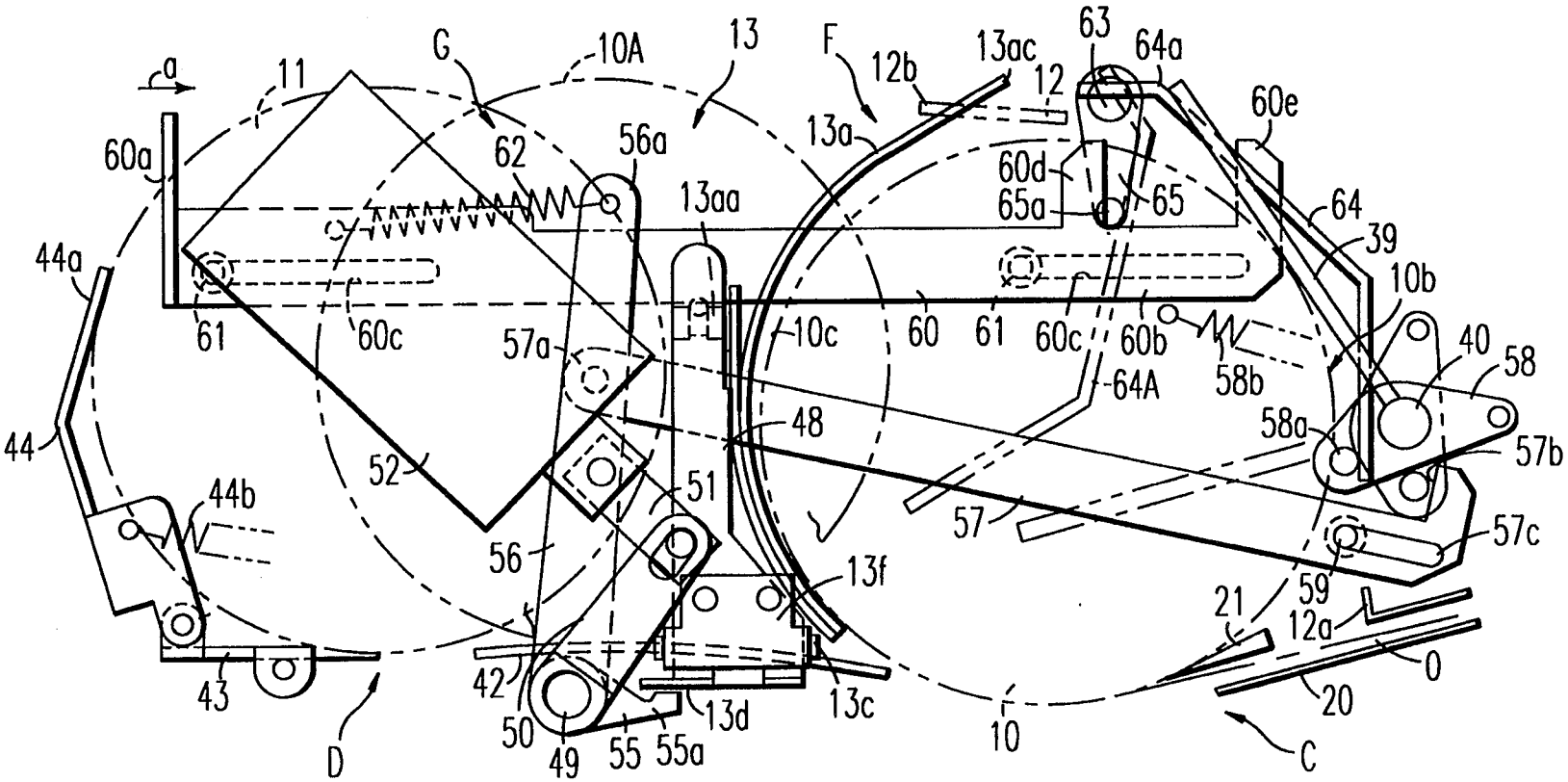
FIG. 1 is an enlarged schematic side elevation of a paper roll support apparatus according to an embodiment of the invention.

A paper roll support apparatus of the invention will be described with reference to an embodiment shown in the drawing figures.

Figure 11:
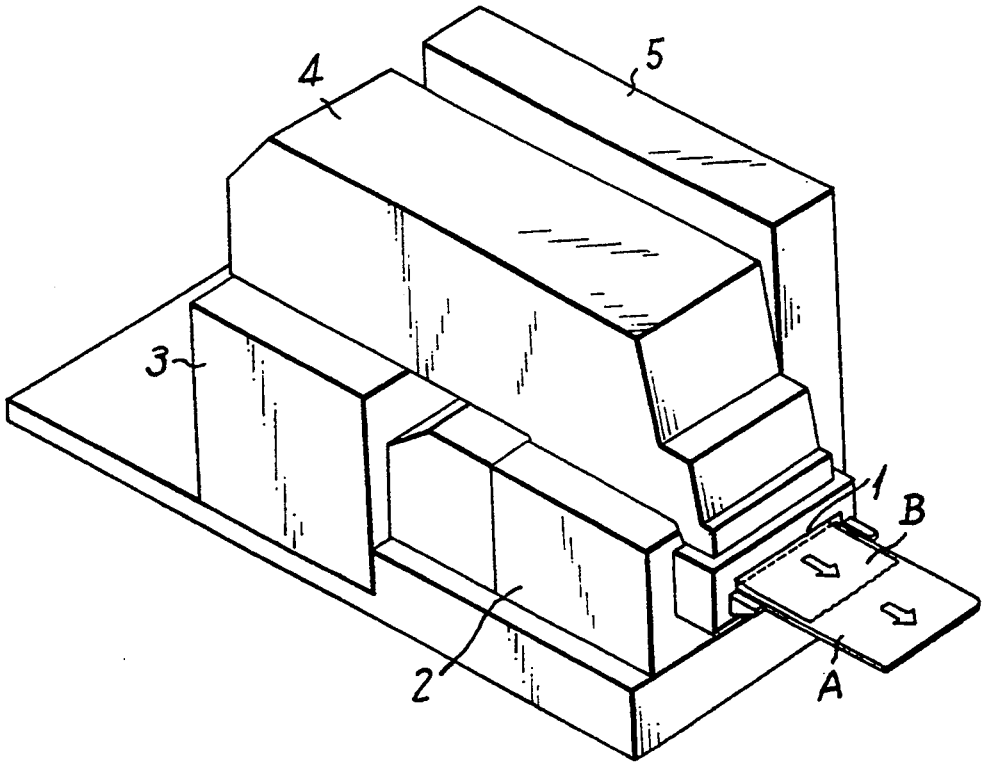
FIG. 11 is a schematic perspective view showing an external appearance of an automatic teller machine.

An outline of an automatic teller machine is described referring to FIG. 11 first of all. When a magnetic card A is put in the machine through a card slit 1, magnetically recorded data on the magnetic card A are read by a card processor 2. After an identification code is input by operating numbered keys and is verified, the customer presses numbered keys to deposit or obtain cash, or make remittance. In case of the remittance, a remittance report (not shown) will be issued by a remittance report printer 3. When all the transactions are completed, the magnetic card 1 will be returned through the card slit 1 together with the balance report B.

A balance report printer 4 is disposed above the card processor 2 and the remittance report printer 3. In FIG. 11, reference numeral 5 denotes a controller for the card processor 2, the remittance report printer 3 and the balance report printer 4, and controls the timed relationship of a magnetic head and a printing head, and operation of various mechanisms for conveying the magnetic card and the printed balance report.

Figure 10:
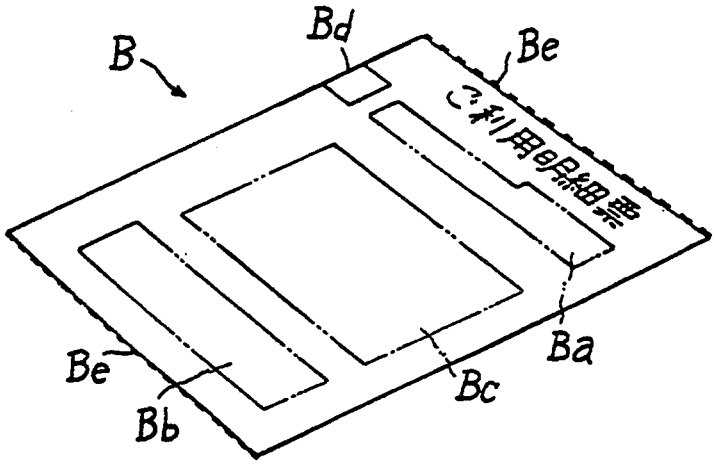
FIG. 10 is an enlarged perspective view of a balance report.

As shown in FIG. 10, the balance report B contains a record of transactions in a bank account such as a bank name Ba, messages Bb and Bc, and a mark Bd. The message Bc represents details of the transactions printed by the printer. The mark Bd serves as a signal source denoting the print start position and the end of the balance report. All the messages except for the message Bc have been already recorded on the paper roll. The paper containing the foregoing data as the balance report is cut to the predetermined length at perforations Be. The issued balance report has perforations at its leading and trailing edges.

The internal structure of the balance report printer will be described by referring to FIGS. 3 and 4. The printer has a main paper roll 10 currently in use, and a spare paper roll 11. The spare paper roll 11 will be guided to a main paper roll support after the main paper roll is used up.

The main paper roll 10 is rotatably seated in the main paper roll support C (to be described later), while the spare paper roll 11 is on a spare paper roll support D (shown in FIG. 6). In the main paper roll support C, the main paper roll 10 is supported by a stationary guide member 12, and a paper roll guide unit F including movable guide members 13 which are counterparts of the stationary guide member 12. An unrolled leading edge of the main paper roll 10 is guided along a paper conveying path O, is cut on the way, and is issued as the balance report B through the card slit 1 (shown in FIG. 11).

The movable guide members 13 are disposed near the paper roll path E which is at the border of the main paper roll support C and the spare paper roll support D, and connect these supports C and D.

The main paper roll support C includes endless belts 18 and 19 trained over shafts 16 and 17 which are rotatably supported at lower edges of a pair of side plates 14 and 15, a support plate 20 fixed on the sides plates 14 and 15, and edges guides 19*a* and 19*b* (shown in FIG. 2) for controlling the edges of the paper roll. The shaft 17 is rotatably coupled to a motor M1, which rotates the main paper roll 10 via the endless belts 18 and 19, thereby unrolling the leading edge of the main paper roll 10. A pick-up claw 21 (shown in FIGS. 1 and 2) is positioned in close contact with the peripheral surface of the main paper roll 10, and picks up the leading edge of the main paper roll 10, and guides it to the paper conveying path O. The support plate 20 includes a lower guide plate 20*a* which extends to the right (shown in FIG. 3) to constitute the paper conveying path O.

A pair of feed rollers 22 are disposed on the paper conveying path O. These rollers 22 are strictly controlled so that they rotate and unroll the main paper roll 10 by sandwiching and drawing the leading edge of the main paper roll 10.

A mark sensor 23 is positioned understream of the feed roller pair 22, and detects the mark Bd (shown in FIG. 10) on a side edge of the paper.

Along the paper conveying path O, there are a printer, a paper cutting roller 26 fixed to the side plates 14 and 15, and a balance report discharging unit 27 in the moving direction of the paper. The printer includes a thermal head 24 and a platen roller 25. A balance report retriever 28 is located above the balance report discharging unit 27. A motor M2 actuates the balance report discharging unit 27 and the balance report retriever 28.

After the mark Bd (FIG. 10) is detected by the mark sensor 23, the paper roll is unwound to the predetermined length by the feed roller pair 22, and is then stopped with its perforated portion contacted with the lower peripheral surface of the paper cutting roller 26.

The balance report discharging unit 27 includes a conveyer belt 29 for downwardly guiding the printed and cut balance report along the paper conveying path O toward the card slit 1 (FIG. 11), a pair of pinch rollers 30 and 31 in contact with the conveyer belt 29, and a belt roller 32 for the balance report retriever 28. The belt roller 32 is in contact with the belt 29.

The paper cutting roller 26 and the pinch roller 30 are disposed with a space therebetween which is shorter than the length of the balance report B. The paper is stopped with its perforated portion aligned on the paper cutting roller 26, is pulled by the balance report discharging unit 27, and is cut at the perforated portion. The balance report discharging unit 27 includes a sensor 33 for detecting the movement of the balance report thereto, and a sensor 34 for detecting the balance report B left behind in the card slit 1.

The balance report retriever 28 is used for retrieving the balance reports which are printed for proofing or a balance report which is left behind by the customer. The retriever 28 includes a belt 36, a pinch roller 37, a box 35, and a sensor 38 for detecting the retrieved balance reports.

Figure 2:
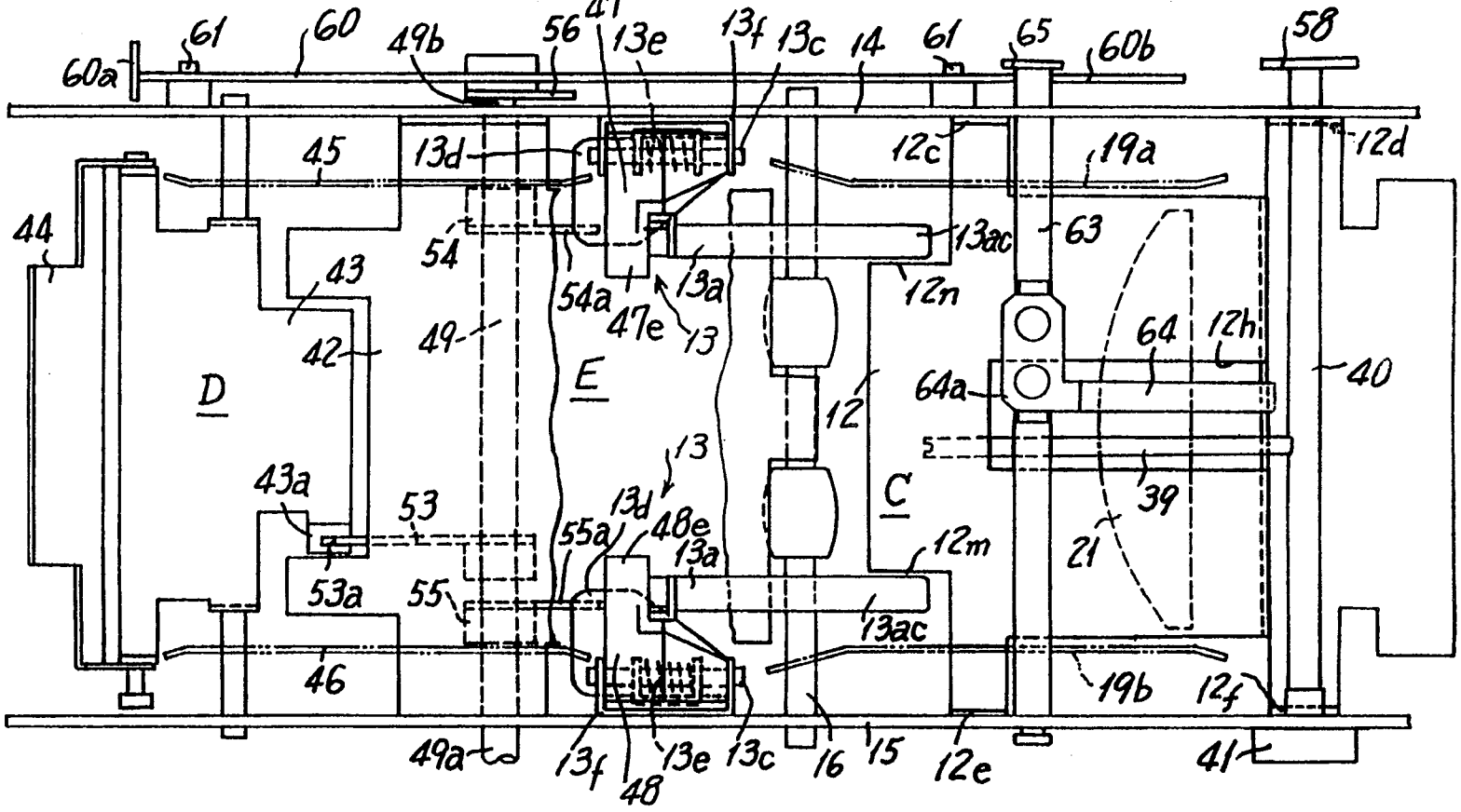
FIG. 2 is a schematic top plan view of the paper roll support apparatus of FIG. 1.

A residual sensor 39 is in contact with the peripheral surface of the main paper roll 10 as shown in FIGS. 1 and 2. The residual sensor 39 detects the residual of the main paper roll 10, and is fixed on a shaft 40 which is rotatably held by the side plates 14 and 15. One end of the shaft 40 is connected to a movable piece of a variable resistor 41. The residual sensor 39 detects the residual of the main paper roll 10 according to a variation of resistance of the variable resistor 41 in response to the reduced diameter of the main paper roll 10. When the paper on the main paper roll is completely consumed, a solenoid 52 (to be described later) will be activated.

Figure 4:
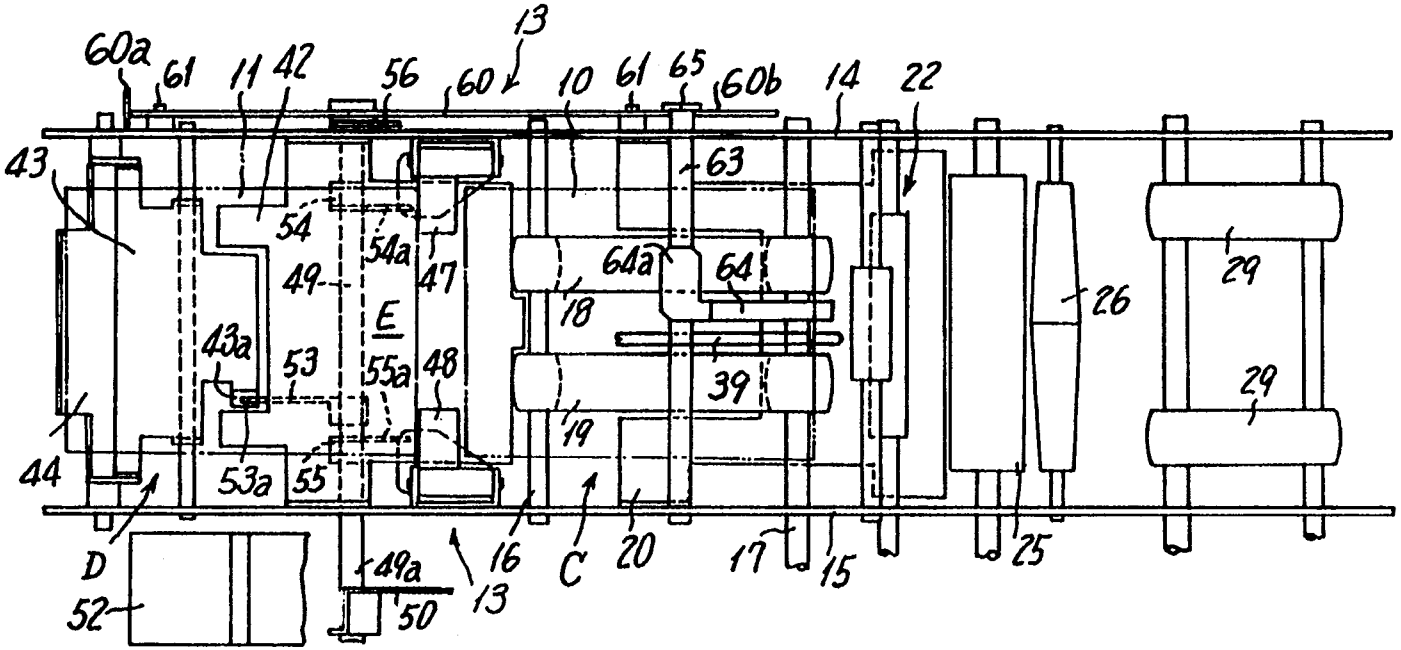
FIG. 4 is a plan view of the main part of the printer of FIG. 3.
Figure 6:
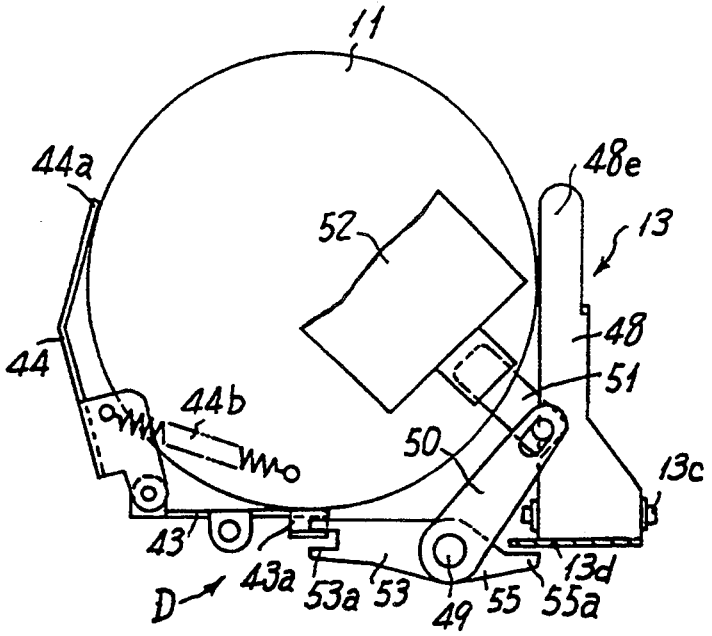
FIG. 6 is an enlarged side elevation of a spare roll support.

The spare paper roll 11 is seated on the spare paper roll support D behind the main paper roll in the moving direction of the paper as shown in FIGS. 2, 4 and 6. The support D includes a stationary support plate 42 fixed on the side plates 14 and 15, a movable support plate 43 (which is movably mounted on the side plates 14 and 15), a paper roll feed plate 44, and edge guides 45 and 46 for guiding the opposite edges of the paper roll.

The paper roll feed plate 44 is pivotally connected to the movable support plate 43, and is biased by a spring **44*b* (shown in FIG. 6) so that an upper edge 44*a* of the paper roll feed plate 44 comes into contact with the rear circumferential surface of the spare paper roll 11. The spare paper roll 11 is pushed by the plate 44, and is in contact with the guide bodies 47 and 48 which are at the main paper roll holding position in the paper roll path E (shown in FIGS. 2 and 4), so that the spare paper roll 11 is prevented from advancing to the main paper roll support C. In other words, the guide bodies 47 ad 48** serves as a part of the spare paper roll support as well as hold the main paper roll.

As shown in FIGS. 1 to 6, a shaft 49 is rotatably connected to the side plates 14 and 15. One end **49*a* of the shaft 49 is coupled to a movable part of the solenoid 52 via a lever 50 and a link 51. The shaft 49 is also coupled to a spare paper roll pushing lever 53 whose end 53*a* is engaged with a step 43*a* of the movable support plate 43. Release levers 54 and 55 are also coupled to the shaft 49. Tips 54*a* and 55*a* of the release levers 54 and 55 are located below the guide bodies 47 and 48, respectively. The shaft 49 and the release levers 54 and 55 constitute a part of a moving mechanism which will be described later. As shown in FIGS. 1 to 4, a base of a moving lever 56 is fixed to the end 49*b* of the shaft 49. One end 57*a* of a lever 57 for rocking the residual sensor 39 is connected to the center of the moving lever 56. The lever 57 has a step 57*b* at the other end. The step 57*b* is engageable with a pin 58*a* of a lever 58 fixed on a shaft 40**.

The lever 57 is slidable by a pin 59 (FIG. 1) embedded in the side plate 14. In this embodiment, the solenoid 52, the guide bodies 47 and 48, and the movable support plate 43 constitute a mechanism for setting the spare paper roll.

As shown in FIGS. 1 to 4, an operating member 60 is slidable by a pair of pins 61 along the side plate 14. A tension spring 62 is trained between the operating member 60 and the tip **56*a* of the moving lever 56. One end 60*a* of the operating member 60 is located near the rear end of the side plate 14. The other end 60*b* of the operating member 60 extends to a side portion of the main paper roll support C. A release lever supporting shaft 63 is rotatably located above the main paper roll support C. A base 64*a* of a paper roll release lever 64 is fixed on the release lever shaft 63**.

In FIGS. 1 and 2, the operating member 60 has a pair of elongate holes **60*c*, into which a pair of pins 61 are engaged so that the operating member 60 is slidable in the distance equal to the length of these holes. The operating member 60 has, at an upper edge of its other end, projections 60*d* and 60*e*** which are spaced as predetermined.

A lever 65 having a pin **65*a* at its end is fixed on the support shaft 63. The pin 65*a* is positioned between projections 60*d* and 60*e* of the operating member 60. The operating member 60 is urged by the spring 62 in the direction shown by an arrow a, and pushes the lever 65 counterclockwise via the pin 65*a* engaged with the projection 60*d*. Thus, the paper roll releasing lever 64 is displaced to the inoperative position (shown by the chain line in FIG. 1**) away from the main paper roll at its regular position.

When the operating member 60 is moved in the direction opposite to the direction shown by the arrow a, the projection **60*e* engages with the pin 65*a*, turns the support shaft 63, and rocks the paper roll releasing lever 64 to the operative position (shown by the dashed line 64A) where the releasing lever 64 strikes the main paper roll 10. The releasing lever 64** is designed to be long enough to push the main paper roll to the spare paper roll support D.

The structure of the paper roll guide unit F will be described in detail.

The paper roll guide unit F serves to rotatably hold, at a predetermined position, the main paper roll 10 seated on the main paper roll support C, and includes the stationary guide member 12 and a pair of movable guide members 13. As shown in FIGS. 1 and 3, the stationary guide member 12 is disposed to cover a front half of the circumferential surface of the main paper roll 10 (in an advancing direction of the paper), and is fixed to the side plates 14 and 15 by pieces 12*c*, 12*d*, 12*e* and 12*f* as shown in FIG. 2.

Only a base end 12*a* and an upper end 12*b* of the stationary guide member 12 are shown in FIG. 1.

The base 12*a* of the stationary guide member 12 constitutes an upper guide plate for the paper conveying path O. The upper end 12*b* of the stationary guide member 12 has steps 12*n* and 12*m* (shown in FIGS. 5 and 7) for controlling the rocking motion of the movable guide members 13 (to be described later). The stationary guide member 12 has an opening 12*h* which the paper roll release lever 64 and the residual sensor 39 go in and out.

The movable guide members 13 include guide pieces 13*a*, which cover the rear circumferential surface of the main paper roll 10 (in the advancing direction of the paper) as shown in FIGS. 1 and 2, and are fixed to the side plates 14 and 15.

As shown in FIGS. 1, 2, 5, and 7 to 9, the movable guide members 13 have guide pieces 13*a*, which are arched to guide the circumferential surface of the main paper roll 10. The movable guide members 13 includes the guide bodies 47 and 48 serving as stops for the spare paper roll 11. Since the movable guide members 13 are symmetrical, the guide member 13 having the guide body 47 will be described as an example. FIG. 1 shows the guide member 13 which has the guide body 48. Now referring to FIG. 9, the guide body 47 is supported by a bracket 13*f* via a shaft 13*c* so as to be freely rocked. An arm 13*d* which is integral with the main guide is inserted into the shaft 13*c* with an upper surface 13*da* of the arm 13*d* contacted with lower ends 47*c* of the guide body 47. The arm 13*d* is located above the tips 54*a* and 55*a* of the drive levers 54 and 55.

Figure 5:
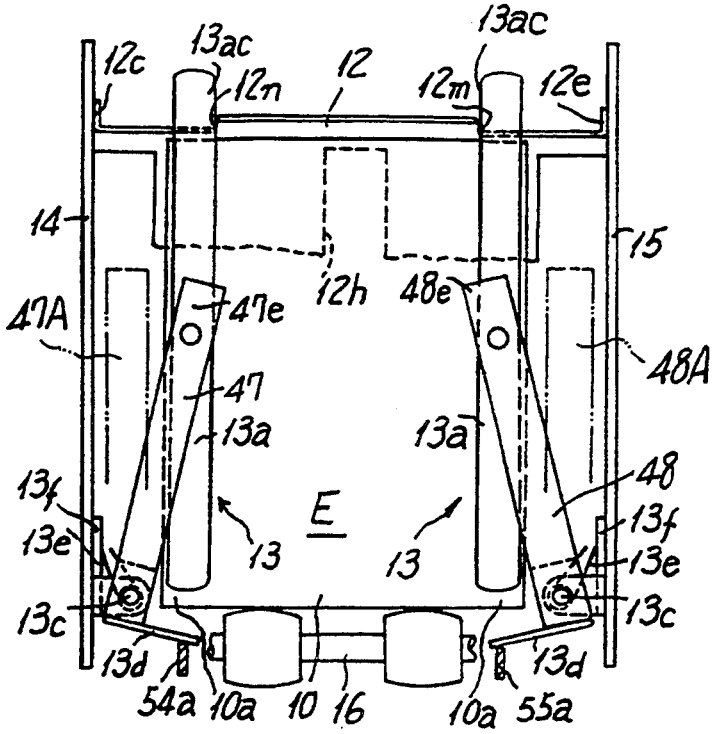
FIG. 5 is an enlarged rear view of a paper roll guide unit.
Figure 7:
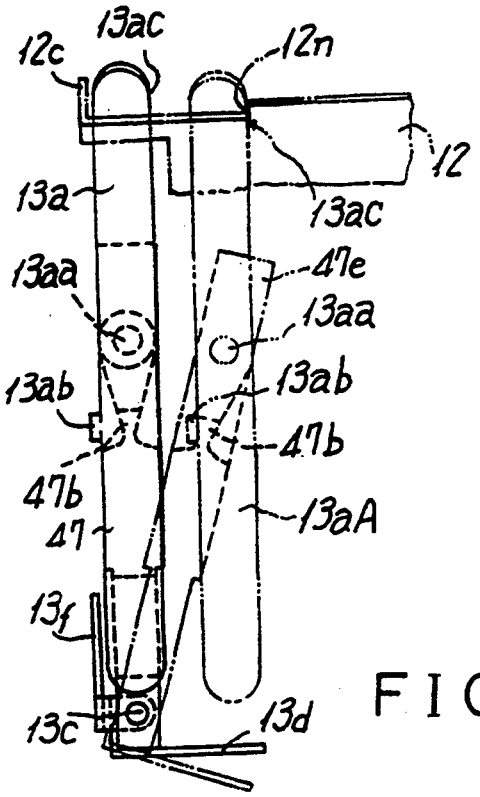
FIG. 7 is an enlarged rear view showing the operation of movable guide members.

The shaft 13*c* has a torsion spring 13*e*, which urges the guide body 47 toward the holding position shown by the solid line in FIG. 5 (shown by the chain line in FIG. 7).

Figure 8A:
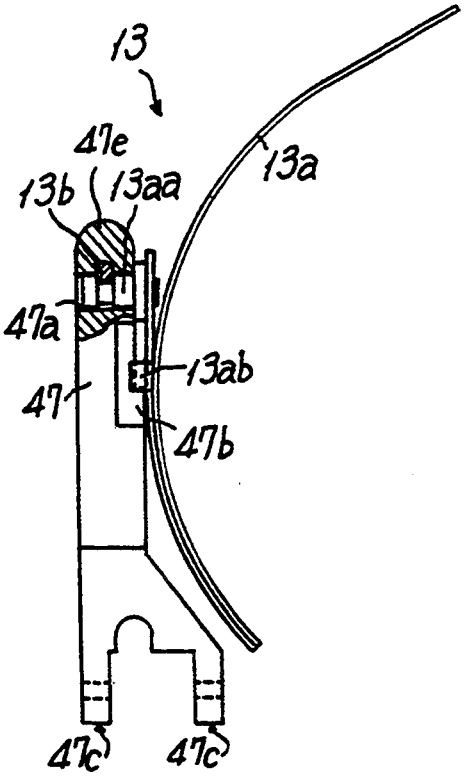
FIG. 8(*a*) is an enlarged side elevation of one of the movable guide members, and FIG. 8(*b*) is an enlarged front elevation of a movable guide.
Figure 8B:
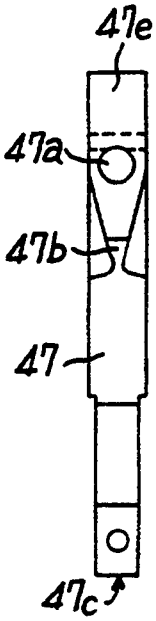
Figure 9:
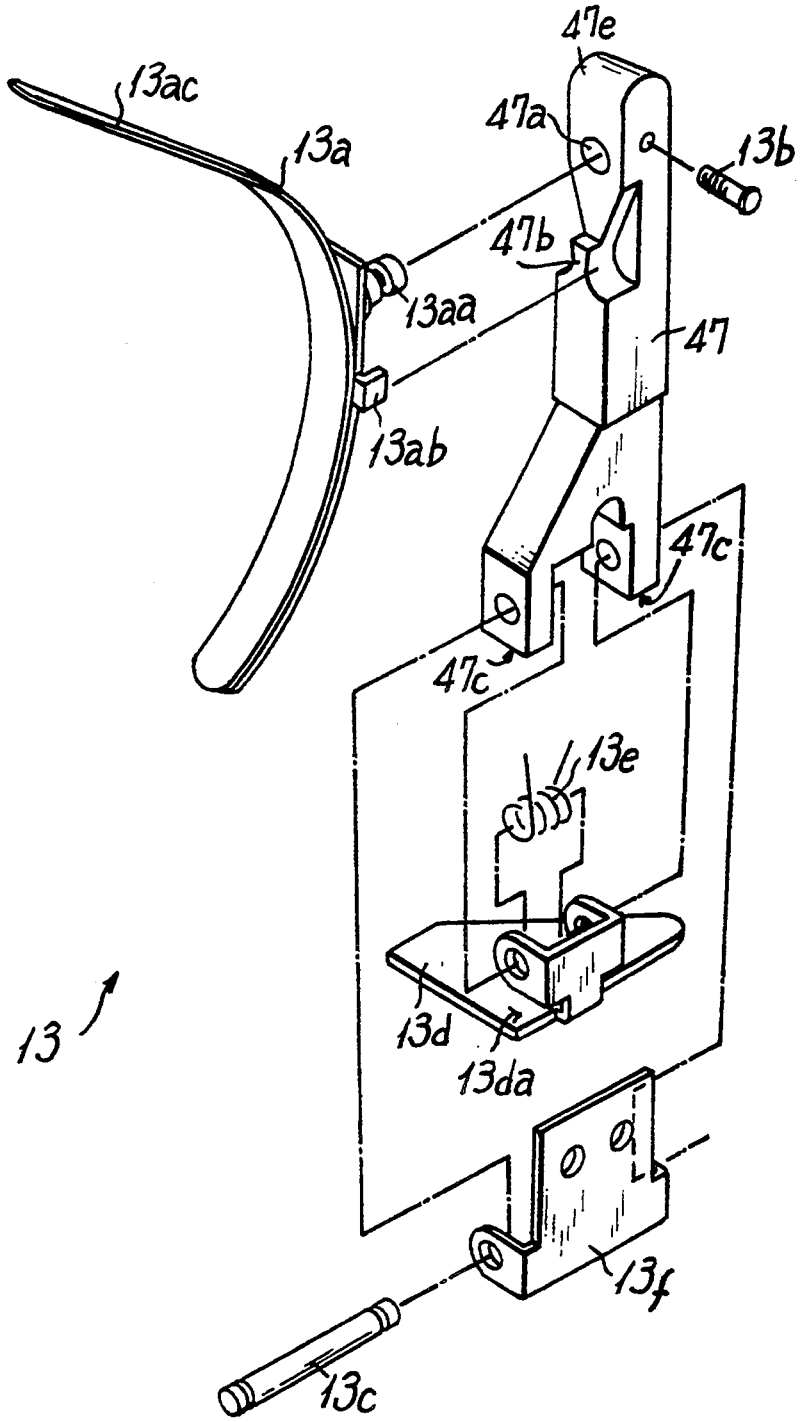
FIG. 9 is an enlarged and exploded perspective view showing the movable guide member, a guide piece and a spring.

Each guide piece 13*a* is made of two piled steel plates, and has a shaft 13*aa* fixed thereto. The shaft 13*aa* is inserted into a hole 47*a* of the guide body 47, and is rotatable in the hole 47*a*. Thus, the guide member 13*a* is rotatably supported by the guide body 47. In FIG. 8(*a*), reference numeral 13*b* denotes a screw for preventing the shaft 13*aa* from getting out of the guide body 47. The guide body 47 has a step 47*b* on its front side, which engages with a member 13*ab* of the movable guide member 13.

The hole 47*a* of the guide body 47 is formed at a position 47*e* which is on a moving orbit of the main paper roll 10 when the guide body 47 is at the holding position (shown by the chain line in FIG. 7).

The guide body 47 is urged by the torsion spring 13*e* toward the holding position as shown in FIGS. 1 and 5 (shown by the solid line) and FIG. 7 (shown by the chain line). Under this condition, the upper end 13*ac* of the guide piece 13*a* strikes the step 12*n* of the stationary guide member 12, so that the guide piece 13*a* rocks pivotally on the shaft 13*aa*. Then, the rocking motion of the guide piece 13*a* is prevented when the member 13*ab* engages with the step 47*b*. Specifically, the rocking motion of the guide body 47 is prevented by the engagement of the guide piece 13*a* with the stationary guide member 12 and the guide body 47. Furthermore, the guide piece 13*a* is made erect at the holding position. The erect guide piece 13*a* confronts with opposite side edges 10*a* of the main paper roll 10 which is supported at the predetermined position, as shown in FIG. 5. A moving unit G is disposed between the operating member 60 and the movable guide member 13 as shown in FIG. 1.

When the operating member 60 is moved backwards, its movement is transmitted to the lever 56 via the spring 62. Then, the lever 56 is rocked counterclockwise, and turns the shaft 49 in the same direction. The lever 56 is coupled to the shaft 49. Following the turning of the shaft 49, a release lever 55 (54) is rocked, pushes the arm 13*d* upwardly by its end 55*a* (54*a*), and displaces the movable guide member 13 to the side position (shown by the chain line in FIG. 5) from the holding position (shown by the solid line in FIG. 5).

The operation of the operating member 60 is transmitted to the movable guide member 13 via the spring 62, the lever 56, the shaft 49, and the release levers 54 and 55, all of which constitute the moving unit G. When the solenoid 52 is turned on, the shaft 49 is turned via the link 51 and the lever 50, and rocks the levers 54 and 55 so as to displace the movable guide members 13. Therefore, the solenoid 52 constitutes a part of the moving unit G.

The operation of the paper roll support apparatus will be described hereinafter.

FIG. 1 shows that the main paper roll 10 in use is seated in the main paper roll support C, and that the spare paper roll 11 is in the spare paper roll support D. The spare paper roll 11 is kept on standby behind the main paper roll 10 by the guide bodies 47 and 48 which are at the regular (?) positions shown by the solid lines in FIG. 5.

Figure 3:
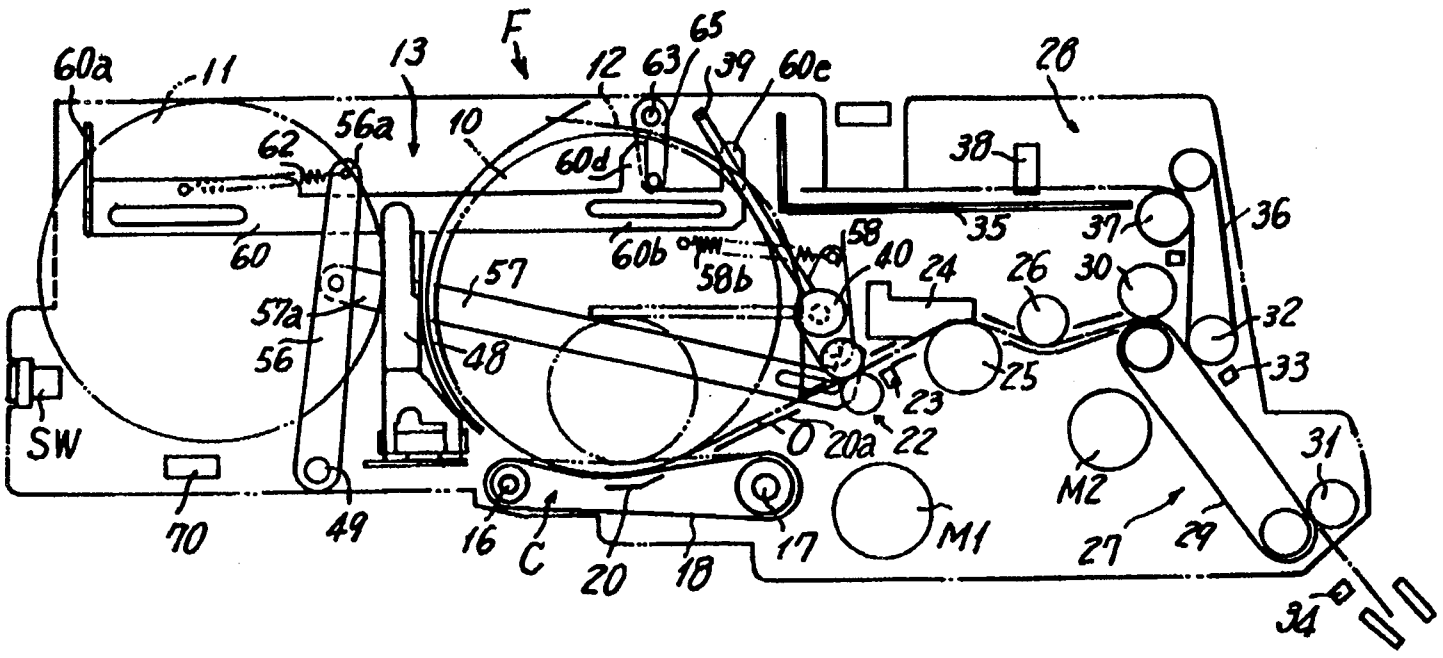
FIG. 3 is a side elevation of an example of a balance report printer to which the paper roll support apparatus is applied.

Referring to FIG. 3, the main paper roll 10 is unrolled by the endless belts 18 and 19. Then, the unrolled portion of the main paper roll 10 is sandwiched between the pair of feed rollers 22 with the leading edge thereof positioned under the paper cutting roller 26. The customer inserts the magnetic card A and operates the numbered keys. After banking transactions are completed, a balance report is printed on the unrolled paper by the printing head 24 while the paper is being fed by the feed roller pair 22. The feed roller pair 22 keep on feeding the unrolled paper until the printing is completed, the mark sensor 23 detects the mark Bd on the balance report (refer to FIG. 10), and the leading edge of the unrolled paper comes under the paper cutting roller 26. Then, the balance report discharging unit 27 conveys the unrolled paper having the balance report thereon. Under this condition, the unrolled and fed paper is cut at its perforated portion, and is discharged as the balance report through the card slit 1 (shown in FIG. 11) with the magnetic card A.

Since the main paper roll 10 is consumed to issue balance reports repeatedly, it becomes smaller, which is detected by the residual sensor 39. The residual sensor 39 rocks according to the residual of the main paper roll 10, so that a resistance of the variable resistor 41 varies with the rocking angle of the residual sensor 39. Therefore, it is possible to know an approximate residual of the main paper roll 10.

Complete consumption of the main paper roll 10 is detected by the residual sensor 39. The variable resistor 41 (shown in FIG. 2) varies its resistance in response to the rocking motion of the residual sensor 39, and a signal is then issued to actuate the solenoid 52. Then, the shaft 49 turns counterclockwise via the link 51 and the lever 50, and rocks the release levers 55 and 54, and the spare roll pushing lever 53 counterclockwise. The tips 55*a* and 54*a* of the release levers 55 and 54 engage with the pair of arms 13*d*, displace the guide bodies 47 and 48 to the side positions 47A and 48A shown by the chain lines in FIG. 5. Thus, the paper roll path E is opened. The spare roll pushing lever 53 rocks the movable support plate 43 clockwise, and turns the spare roll 11 to the right in the plane shown in FIG. 6. In response to the rocking motion of the movable support plate 43, the paper roll feeding plate 44 urged by the spring 44*b* is moved upwards so as to push and roll the spare paper roll 11 further.

The spare paper roll 11 keeps on rolling toward the main paper roll support C. Then, the solenoid 52 is turned off by a signal, so that the guide bodies 47 and 48 are returned to the regular positions shown by the solid lines.

The spare paper roll delivered to the main paper roll support C is rotated by the endless belts 18 and 19. Then, the leading edge of the paper roll is unrolled and conveyed toward the feed roller pair 22. The mark sensor 23 detects the identification mark Bd on the unrolled paper. Thereafter, the unrolled paper is continuously fed and comes under the paper cutting roller 26, and is stopped there. Thus, the paper is ready for printing thereon.

When the spare paper roll 11 begins to serve as the main paper roll 10, a spare paper roll sensor 70 (shown in FIG. 3) alerts an absence of the spare paper roll.

As described so far, the spare paper roll 11 can be set in the position from behind the main paper roll 10. When the paper roll is placed on the main paper roll support C in the wrong direction, the guide bodies 47 and 48 are retracted from the paper roll path E, the paper roll in question is moved to the spare paper roll support D, and the direction of the paper roll is corrected. Then, the paper roll is reloaded on the main paper roll support C. The guide bodies 47 and 48 may be moved to the side position by hands, or by manually operating the solenoid 52.

The main and spare paper roll supports C and D are neatly juxtaposed in a narrow space, but there is a free open space above them. It is relatively difficult to pick a paper roll up from the support C or D. The space around the paper roll supports C and D is enough to manually reload the main paper roll or replenishing of a spare paper roll.

To set the main paper roll 10, a switch SW (shown in FIG. 3) is turned on to actuate the solenoid 52, which causes the shaft 49 to turn counterclockwise via the link 51 and the lever 50. In response to the operation of shaft 49, the release levers 54 and 55 are rocked upward. These release levers 54 and 55 are engaged with the arms 13*d*, and rock the movable guide members 13 to the side positions (shown by the chain line in FIG. 5) from the holding positions (shown by the solid line in FIG. 5). The rocking motion of the lever 56 moves the lever 57, which swings the residual sensor 39 to the side position (shown by the solid line in FIG. 1) via the lever 58 and the shaft 40.

Under this condition, the paper roll releasing lever 64 is kept at the inoperative position (shown by the solid line in FIG. 1) by the resiliency of the spring 62. The side positions of the movable guide members 13 represent positions which permit the main paper roll 10 to be moved from by the main paper roll support C to the spare paper roll support D, or vice versa.

Then, the plate 44 is turned counterclockwise so as to open the paper roll loading path. The paper roll is set on the spare paper roll support D, and is then rolled toward the main paper roll support C.

When the main paper roll 10 gets to the predetermined position, it is placed on the stationary support plate 20 and the belts 18 and 19 as shown in FIG. 3. Thereafter, the solenoid is turned off, the release levers 54 and 55 return to their original positions, and the movable guide members 13 also return to the holding positions shown by the solid line in FIG. 5.

When the movable guide member 13 returns to the holding position and the part 47*e* thereof is above the moving orbit of the paper roll, the guide piece 13*a* rocks pivotally on the shaft 13*aa* since the upper end 13*ac* of the guide piece 13*a* engages with the stops 12*n* and 12*m* of the stationary guide member 12. When the member 13*ab* of the movable guide member 13 engages with the step 47*b* of the guide body 47, the movable guide member 13 stands erect as shown by the chain line 13*a*A in FIG. 7. Thus, as shown in FIG. 1, the front half 10*b* of the main paper roll 10 is covered by the stationary guide member 12, and the rear half 10*c* of the main paper roll 10 is covered by the guide piece 13*a*.

A new paper roll 11 is then set on the spare paper roll support D. Since there is a free open space around the spare paper roll support D, the spare paper roll can be easily corrected when it is wrongly set.

If the main paper roll 10 is found to be loaded in the wrong direction, the operating member 60 will be moved in the direction opposite to the direction shown by the arrow a shown in FIG. 1. The movement of the operating member 60 is transmitted to the movable guide member 13 via the spring 62, the lever 56, the shaft 49, and the release levers 54 and 55. Thus, the movable guide member 13 is moved to the side position shown by the chain line in FIG. 5 (i.e. shown by the solid line in FIG. 7). As the operating member 60 moves, its tip 60*e* engages with the pin 65*a* of the lever 65, and turns the shaft 63, which rocks the paper roll releasing lever 64 to the operative position (shown by the chain line 64A in FIG. 1) from the inoperative position (shown by the solid line in FIG. 1.

When the paper roll releasing lever 64 turns, the reversely set paper roll 10 which is on the moving orbit of the lever 64 is rolled toward the spare paper roll support D. Specifically, as shown by reference numeral 10A in FIG. 1, this paper roll 10 passes through the movable guide members 13 (shown by the solid line in FIG. 7) which are at the side portions and open the paper roll path E, and reaches the spare paper roll support D. Then, the paper roll 10 is corrected its direction, is reloaded, and is conveyed to the main paper roll support C. Under this condition, the operating member 60 is returned in the direction shown by the arrow a by the resiliency of the spring 62, and the paper roll releasing lever 64 is at the inoperative position shown by the solid line in FIG. 1.

APPLICABILITY FOR INDUSTRIAL USE

As described above, since the spare paper roll is juxtaposed behind the main paper roll, it is possible to save a space in the vertical direction. Resupply or correction of paper rolls can be easily performed from behind the apparatus.

The paper rolls can be easily set or removed in or from the narrow paper roll supports. The guide members for guiding the paper rolls are movable between the holding and side positions in a narrow space, which makes the support apparatus compact.

What is claimed is:

1. A paper roll support apparatus comprising:

a main paper roll support means (C) for rotatably supporting a main paper roll;

a paper feed means (22) for unrolling the main paper roll (10) and feeding the unrolled paper;

a spare paper roll support means (D) for supporting a spare paper roll and located behind the main paper roll support means (C);

a residual sensor (39, 41) for detecting a residual of the main paper roll (10) supported by the main paper roll support means (C);

a setting means (43, 49, 50, 52) for setting the spare paper roll according to the residual of the main paper roll detected by the residual sensor (39, 41);

a paper roll guiding means (F) including: a stationary guide member (12) for rotatably supporting at a predetermined position the main paper roll (10) supported by the main paper roll support means (C); and at least one movable guide member (13) which is a counterpart of the stationary guide member (12) and is movable between a main position for holding the main paper roll (10) and a side position for releasing the main paper roll (10); and a paper roll releasing mechanism including: a paper roll release lever (64) for pushing and releasing the main paper roll (10), being movable between an inoperative position away from the main paper roll (10) and an operative position for striking the main paper roll (10), and being located opposite to the movable guide member (13) with the main paper roll (10) sandwiched therebetween; an operating member (60) for selectively moving the paper roll release lever (64) to either the inoperative or operative position; and a moving means (49, 54, 55, 56, 62) for moving the movable guide member (13) to the side position in response to the operation of the operating member (60).

2. A paper roll support apparatus comprising:

main paper roll support means (C) for rotatably supporting a main paper roll (10);

paper feed means (22) for unrolling the main paper roll (10) and feeding the unrolled paper;

paper roll guiding means (F) including a stationary guide member (12) for rotatably supporting at a predetermined position the main paper roll (10) supported by the main paper roll support means (C), and at least one movable guide member (13) which is a counter part of the stationary guide member (12) and is movable between a main position for holding the main paper roll (10) and a side position for releasing the main paper roll (10);

spare paper roll support means (D) for supporting a spare paper roll and located behind the main paper roll support means (C);

spare paper roll stop means (47, 48) for preventing the spare paper roll (11) from advancing toward the main paper roll support means (C), the spare paper roll stop means having the movable guide member (13) fitted thereto and being positioned so as to be reciprocative in a paper roll path (E) between the spare roll support means (D) and the main paper roll support means (C);

a residual sensor (39, 41) for detecting a residual of the main paper roll supported by the main paper roll support means (C); and setting means (43, 49, 50, 52) for setting the spare paper roll according to the residual of the main paper roll detected by the residual sensor (39, 41).

3. A paper roll support apparatus comprising:

a main paper roll support means (C) for rotatably supporting a main paper roll;

a paper feed means (22) for unrolling the main paper roll (10) and feeding the unrolled paper;

a spare paper roll support means (D) for supporting a spare paper roll and located behind the main paper roll support means (C);

a residual sensor (39, 41) for detecting a residual of the main paper roll (10) supported by the main paper roll support means (C);

a setting means (43, 49, 50, 52) for setting the spare paper roll according to the residual of the main paper roll detected by the residual sensor (39, 41);

a stationary guide member (12) for surrounding a part of the circumferential surface (**10*b*) of the main paper roll (10**) supported by the main paper roll support means;

at least one movable guide member (13) which is a counterpart of the stationary guide member (12) and is movable between a main position for holding the main paper roll (10) and a side position for moving the main paper roll (10);

at least one guide piece (**13*a*) which rocks freely on a part of the movable guide member (13), includes an engaging member (13*ab*) for keeping the movable guide member (13) located at the holding position with a predetermined angle, and covers the other part (10*c*) of the circumferential surface of the main paper roll (10**);

stop members (**12*n*, 12*m*) which engage with the guide piece (13*a*) when the movable guide member (13) is placed on the holding position, thereby preventing movement of the movable guide member (13**);

at least one spring (**13*e*) for urging the movable guide member (13) toward the holding position; and a driving means (50, 51, 52, 54, 55) for moving the movable guide member (13**) from the holding position to the side position.

* * * * *